US010227728B2

(12) United States Patent
Mellander et al.

(10) Patent No.: US 10,227,728 B2
(45) Date of Patent: Mar. 12, 2019

(54) PULP PRODUCTION ARRANGEMENT AND METHOD

(71) Applicant: Valmet AB, Sundsvall (SE)

(72) Inventors: Stefan Mellander, Alnö (SE); Peter Svedberg, Alnö (SE)

(73) Assignee: Valmet AB (SE)

( * ) Notice: Subject to any disclaimer, the term of this patent is extended or adjusted under 35 U.S.C. 154(b) by 402 days.

(21) Appl. No.: 15/102,021

(22) PCT Filed: Dec. 15, 2014

(86) PCT No.: PCT/SE2014/051495
§ 371 (c)(1),
(2) Date: Jun. 6, 2016

(87) PCT Pub. No.: WO2015/094093
PCT Pub. Date: Jun. 25, 2015

(65) Prior Publication Data

US 2016/0305067 A1 Oct. 20, 2016

(30) Foreign Application Priority Data

Dec. 19, 2013 (SE) ..... 1351529

(51) Int. Cl.
*D21F 1/50* (2006.01)
*D21F 1/76* (2006.01)
(Continued)

(52) U.S. Cl.
CPC ..... *D21C 9/18* (2013.01); *B30B 9/20* (2013.01); *D21C 9/06* (2013.01); *D21F 1/50* (2013.01);
(Continued)

(58) Field of Classification Search
CPC ..... D21F 1/50; D21F 1/74; D21F 1/76; D21F 1/78; D21F 3/08; D21F 3/083; D21F 3/10;
(Continued)

(56) References Cited

U.S. PATENT DOCUMENTS 2,191,144 A * 2/1940 Hornbostel ..... D21F 3/08 100/106
2,338,465 A * 1/1944 Street ..... D21F 3/10 15/DIG. 7
(Continued)

FOREIGN PATENT DOCUMENTS

CN 86206333 U 9/1987
CN 2500704 Y 7/2002
(Continued)

OTHER PUBLICATIONS

Extended European Search Report for Appl. EP14671933.9 dated Jul. 5, 2017.
(Continued)

*Primary Examiner* — Jason L Vaughan
(74) *Attorney, Agent, or Firm* — Lerner, David, Littenberg, Krumholz & Mentlik, LLP

(57) ABSTRACT

A dewatering roll (10) comprises a roll body (20), a mantle support structure (30) and a mantle (40). The mantle support structure (30) is attached around the roll body (20). The mantle (40) is attached against an outer surface (36) of the mantle support structure (30). The mantle (40) has a plurality of through holes (42) constituting mantle flow paths (44). The mantle support structure (30) presents support flow paths (38) from the outer surface (36) of the mantle support structure (30). The support flow paths (38) are in fluid contact with the mantle flow paths (44). The outer surface (36) of the mantle support structure (30) has a static geometric shape defining an envelope having a smaller radius in
(Continued)

vicinity of each axial end (15) than in vicinity of a center (16). Thereby, the inner surface (48) of the mantle (44) assumes the shape of the envelope.

14 Claims, 4 Drawing Sheets

(51) Int. Cl.

| | |
|---|---|
| ***D21F 3/10*** | (2006.01) |
| ***D21F 5/02*** | (2006.01) |
| ***B30B 9/20*** | (2006.01) |
| ***D21C 9/06*** | (2006.01) |
| ***D21C 9/18*** | (2006.01) |

(52) U.S. Cl.
CPC ..... *D21F 1/76* (2013.01); *D21F 3/105* (2013.01); *D21F 5/021* (2013.01)

(58) Field of Classification Search
CPC . D21F 3/105; D21F 5/02; D21F 5/021; D21C 9/18; D21C 9/06; B30B 9/20
See application file for complete search history.

(56) References Cited

U.S. PATENT DOCUMENTS

| | | | | | |
|---|---|---|---|---|---|
| 3,562,883 | A * | 2/1971 | Kobayashi | D21F 3/105 | 162/372 |
| 3,590,453 | A * | 7/1971 | Bryand | B01D 33/067 | 492/32 |
| 3,837,593 | A | 9/1974 | Dorfel | | |
| 3,913,240 | A * | 10/1975 | Flamig | D21F 5/02 | 162/357 |
| 3,991,669 | A * | 11/1976 | Cumbers | D21G 1/0026 | 100/162 B |
| 4,121,968 | A * | 10/1978 | Wells | D21C 9/06 | 162/290 |
| 4,366,025 | A * | 12/1982 | Gordon, Jr. | D21F 3/105 | 100/118 |
| 4,683,744 | A | 8/1987 | Ginzburg et al. | | |
| 4,750,340 | A | 6/1988 | Anderson | | |
| 4,861,433 | A * | 8/1989 | Eriksson | D21C 9/18 | 162/323 |
| 5,412,870 | A * | 5/1995 | Lehtonen | B29C 41/085 | 29/895 |
| 6,311,849 | B1 * | 11/2001 | Sbaschnigg | D21C 9/06 | 162/251 |
| 7,214,172 | B2 | 5/2007 | Lundberg et al. | | |
| 8,187,125 | B2 | 5/2012 | Kaufman | | |
| 8,562,498 | B2 | 10/2013 | Mossberg | | |
| 2005/0230306 | A1 * | 10/2005 | Sicley | D21D 1/40 | 210/523 |
| 2011/0233130 | A1 | 9/2011 | Lindkvist | | |

FOREIGN PATENT DOCUMENTS

| | | | |
|---|---|---|---|
| CN | 1545586 | A | 11/2004 |
| CN | 101535564 | A | 9/2009 |
| CN | 101896664 | A | 11/2010 |
| CN | 102165115 | A | 8/2011 |
| DE | 4241040 | A1 | 6/1994 |
| EP | 0471655 | A1 | 2/1992 |
| WO | 8706282 | A1 | 10/1987 |
| WO | 9011809 | A1 | 10/1990 |
| WO | 9322028 | A1 | 11/1993 |
| WO | 9636817 | A1 | 11/1996 |
| WO | 0079039 | A1 | 12/2000 |
| WO | 03018907 | A1 | 3/2003 |
| WO | 2004101266 | A2 | 11/2004 |
| WO | 20060056649 | A1 | 6/2006 |
| WO | 2007004968 | A1 | 1/2007 |
| WO | 2008063122 | A1 | 5/2008 |
| WO | 20090075642 | A1 | 6/2009 |
| WO | 2010036192 | A1 | 4/2010 |
| WO | 20100036194 | A1 | 4/2010 |

OTHER PUBLICATIONS

International Search Report and Written Opinion for Application No. PCT/SE2014/051495 dated Mar. 17, 2015.
Wenyi, Liu, et al. "Small Paper Factory Production Process", May 1982, translation of part of p. 132, Agriculture Press (Beijing).

* cited by examiner

PULP PRODUCTION ARRANGEMENT AND METHOD

CROSS REFERENCE TO RELATED APPLICATIONS

The present application is a national phase entry under 35 U.S.C. § 371 of International Application No. PCT/SE2014/051495, filed Dec. 15, 2014, which claims priority to Swedish Patent Application No. 1351529-1, filed Dec. 19, 2013, the disclosures of which are incorporated herein by reference.

TECHNICAL FIELD

The present document relates in general to fibre dewatering devices in pulp production and in particular to dewatering roll arrangements.

BACKGROUND

In pulp production, fibres are caused to be suspended in a water solution by means of mechanical and/or chemical processes. The fibres are also washed at different point along the process. Therefore, in many stages along a pulp production line, there is a need for dewatering the pulp suspension. In a typical example, dewatering of the pulp may be performed from an inlet pulp concentration of 2-10% by weight to an output pulp concentration of 20-50% by weight.

One type of dewatering device is the twin-roll dewatering device. In such a device, the fibre suspension is brought into contact with the mantle plate of a roll. The mantle surface is typically perforated with dewatering channels in a relatively dense pattern. Two such rolls are rotated in opposite directions to bring the fibre suspension into a small gap between the rolls. The water is thereby pressed out from the suspension through the dewatering channels of the mantle plate and into flow paths within the structures of the rolls. The majority of the fibres remain outside the mantle and a pulp with much lower water content exits in the small gap on the other side. The dewatered liquid is typically transported axially along the rolls and exits the device in the vicinity of one or both of the roll ends.

The dewatering efficiency depends to a high degree on the nip between the rolls. In order to achieve a well-defined and efficient dewatering, it is advantageous to have the same load along the axial direction of the rolls within the nip section. However, since the force holding the rolls together is applied at the axial ends of the rolls and the load from the fibre suspension dewatering operation is spread over the entire length of the rolls, there will be a certain tendency of a bending of the rolls. The gap at the middle parts of the rolls will therefore be somewhat larger than the gap in the vicinity of the ends of the rolls. For short rolls, such bending of the rolls may be small enough to be neglected or at least acceptable. However, since the tendency is to provide longer and longer rolls in order to increase the put-through, such bending effects may be quite severe. In the middle part of the device, the dewatering efficiency will be reduced, and if the gap is generally decreased to mitigate such effects, the load at the rolls close to the ends becomes very high indeed, which may cause mechanical damage on the rolls. The high load is caused by a highly non-linear compressibility of the pulp.

Similar effects are also present in e.g. paper machines. The typical approach for compensate for such effects is to perform a machining of the rolls in order to give a somewhat smaller roll radius close to the ends of the rolls and a larger radius in the middle. However, paper machine solutions are not applicable for pulp dewatering purposes, since the dewatering process takes place via a relatively thin mantle plate. The volume inside the mantle plate is used for allowing the liquid extracted from the fibre suspension to exit the device. Machining of a mantle plate of a fibre suspension dewatering roll will either decrease the mechanical strength of the mantle at the roll ends or require longer dewatering channels through the mantle plate in particular at the centre of the rolls, which is not acceptable.

SUMMARY

A general object of the present technology is to provide devices and method for equalizing the nip against a dewatering roll along the axis of the dewatering roll. This object is achieved by devices and methods according to the attached independent patent claims. Preferred embodiments are defined in dependent claims. In general words, in a first aspect, a dewatering roll comprises a roll body, a mantle support structure and a mantle. The mantle support structure is attached, in a radial direction, around the roll body. The mantle is attached, in the radial direction, against an outer surface of the mantle support structure. The mantle has a plurality of through holes constituting mantle flow paths from an, in the radial direction, outer surface of the mantle to an, in the radial direction, inner surface of the mantle. The mantle support structure presents support flow paths from the outer surface of the mantle support structure. The support flow paths are in fluid contact with the mantle flow paths. The outer surface of the mantle support structure has a static geometric shape defining an envelope having a smaller radius in vicinity of each axial end of the mantle support structure than in vicinity of a centre of the mantle support structure. Thereby, the inner surface of the mantle assumes the shape of the envelope.

In a second aspect, a dewatering press comprises at least one dewatering roll according to the first aspect.

In a third aspect, a method for producing a dewatering roll, comprises providing of a mantle support structure with support flow paths from an, in a radial direction, outer surface of the mantle support structure. The mantle support structure is attached around a roll body. A mantle is provided with a plurality of through holes constituting mantle flow paths from an, in the radial direction, outer surface of the mantle to an, in the radial direction, inner surface of the mantle. The outer surface of the mantle support structure is formed to obtain a static geometric shape defining an envelope having a smaller radius in vicinity of each axial end of the mantle support structure than in vicinity of a centre of the mantle support structure. The mantle is fitted against the outer surface of the mantle support structure. The support flow paths are thereby brought in fluid contact with the mantle flow paths. The forming of the outer surface of the mantle support structure is performed before fitting the mantle against the outer surface of the mantle support structure.

One advantage with the presently presented technology is that a homogeneous load can be obtained along the entire length of a dewatering roll. Further advantages are presented in connection with the detailed description of different embodiments below.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

Figure 1:
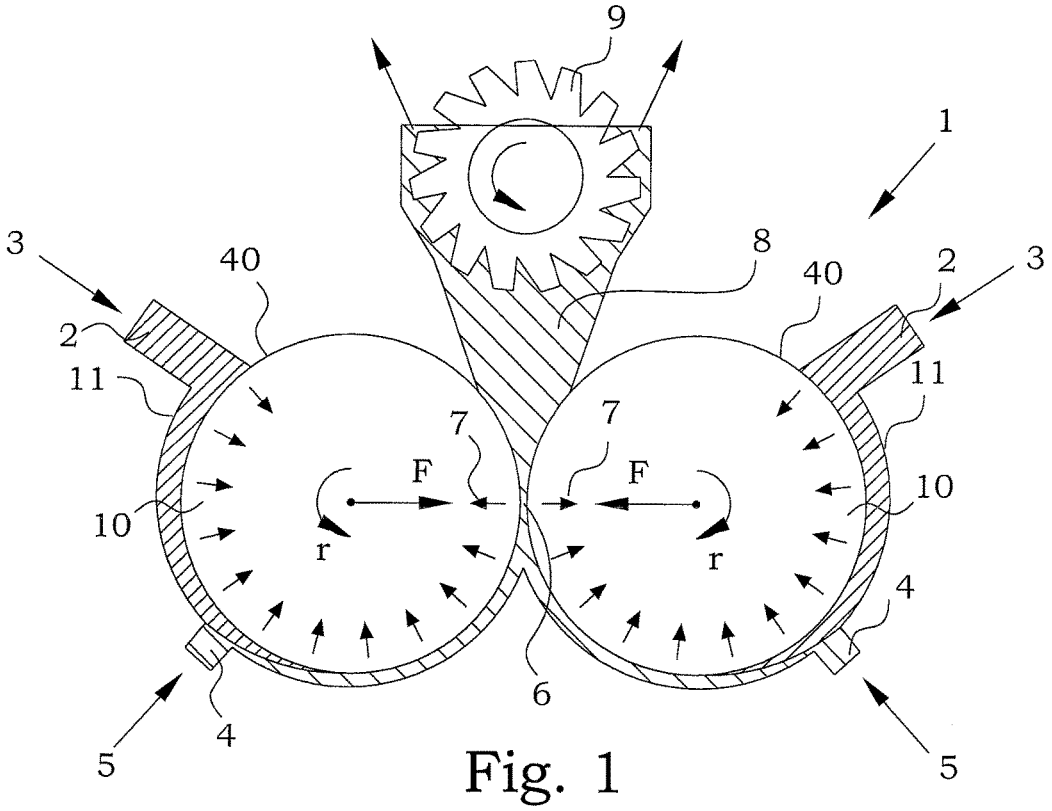
FIG. 1 is a schematic illustration of a twin roll press operation principle.

Since the present ideas are closely connected to the dewatering process of a dewatering roll, this process will first be described in somewhat more detail. FIG. 1 illustrates schematically a twin-roll press 1. The twin-roll press 1 comprises two dewatering rolls 10. Each dewatering roll 10 has a mantle 40, which is perforated by holes in a radial direction. The dewatering rolls 10 are rotating in opposite directions, indicated by the arrows r. Fibre suspension 3, e.g. pulp suspension, is entered by a suspension inlet 2 into an enclosing volume 11 provided around, in a tangential direction, at least a part of the respective dewatering roll 10. The enclosing volumes 11 of the two dewatering rolls 10 are merging close to a nip section 6 between the dewatering rolls 10. The dewatering rolls are positioned at a predetermined distance from each other, leaving a gap within the nip section 6.

The suspension 3 entered into the enclosing volume 11 is transported by the rotation of the dewatering rolls 10 along in the rotation. Most of the free liquids of the suspension 3 entered into the enclosing volume 11 can during this transportation pass through, indicated by arrows 7, the holes of the mantle 40, due to the vat pressure used when entering the suspension 3. When the suspension 3 reaches the nip section 6, the volumes is reduced and the suspension will be exposed for a load, pressing the suspension towards the mantles 40 of the dewatering rolls 10. In order to maintain this load, the dewatering rolls are pushed towards each other with a force F. This pressing squeezes the filtrate out of the fibre suspension. A large portion of the remaining liquids in the suspension is thereby forced through the holes of the mantle 40. Typically, about 70-95% of the input liquids can be removed in this way, leaving a pulp with a consistency of about 30%. A fibre-containing material 8 is provided at the exit from the nip section, which is transported away by suitable transportation means 9.

In embodiments where the dewatering process is required to be combined with a washing procedure, a washing liquid 5 can be introduced through a wash liquid inlet 4 into the enclosing volume 11 for displacing "dirty" liquids from the suspension. Note, however, that this washing step is optional.

Figure 2:
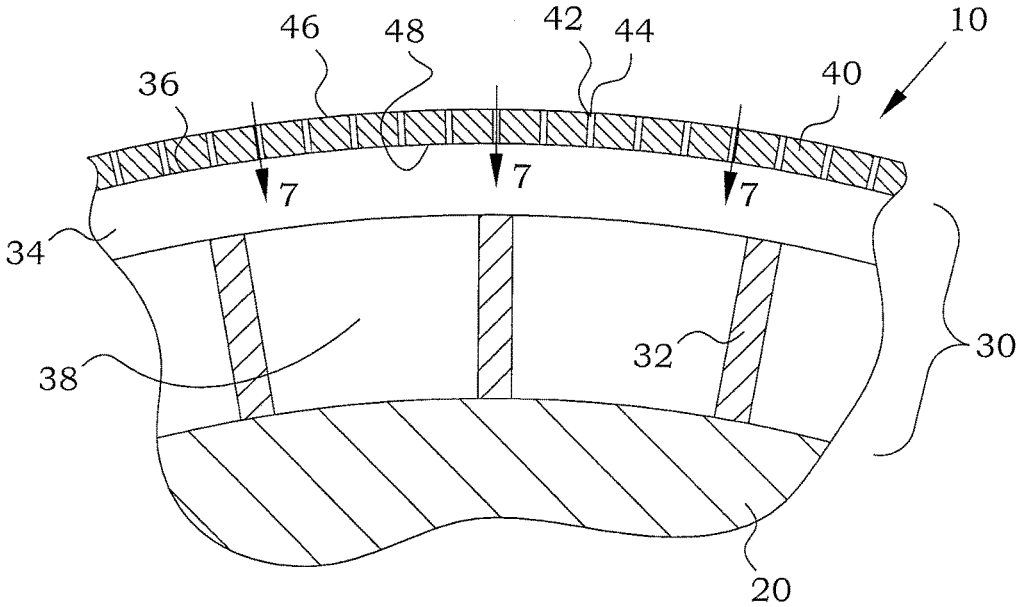
FIG. 2 is a schematic view of a part of an enlarged cross-sectional view of a dewatering roll.

FIG. 2 illustrates a part of a dewatering roll 10 in a cross-sectional view. The mantle 40 has a large number of through holes 42 constituting mantle flow paths 44 for liquids passing 7 through the mantle 40 from an outer surface 46 into the interior of the dewatering roll 10. The mantle 40 is supported by a mantle support structure 30, in this embodiment comprising ring elements 34 attached on support ribs 32 provided in an axial direction. The mantle 40 is fitted with an inner surface 48 against an outer surface 36 of the mantle support structure 30. The mantle support structure 30 is in turn attached to a roll body 20. The liquids resulting from the dewatering process are thus provided into the interior of the dewatering roll 10 inside the mantle 40. The mantle 40 is relatively thin in order to provide low flow resistance through the mantle flow paths 44. Once the liquids exit the mantle flow paths 44, they enter into support flow paths 38 provided by the geometrical structure of the mantle support structure 30. In this embodiment, there are radially directed part flow paths between the ring elements 34 flowing into axially directed part flow paths between the support ribs 32. The support flow paths 38 are thus in fluid contact with the mantle flow paths 44.

In alternative embodiments, the support flow paths could be provided in other ways. The support flow paths 38 could in one alternative e.g. have an axial flow direction in the volumes that are in direct contact with the mantle flow paths. In another alternative embodiment, the support flow paths 38 could have a substantially radial flow direction, delivering the liquids from the mantle inwards towards the axis of the roll body. The roll body could then be arranged for receiving the dewatering liquids, e.g. by channels through the roll body surface, and remove the dewatering liquids from the system, e.g. through a hollow roll body.

Figure 3:
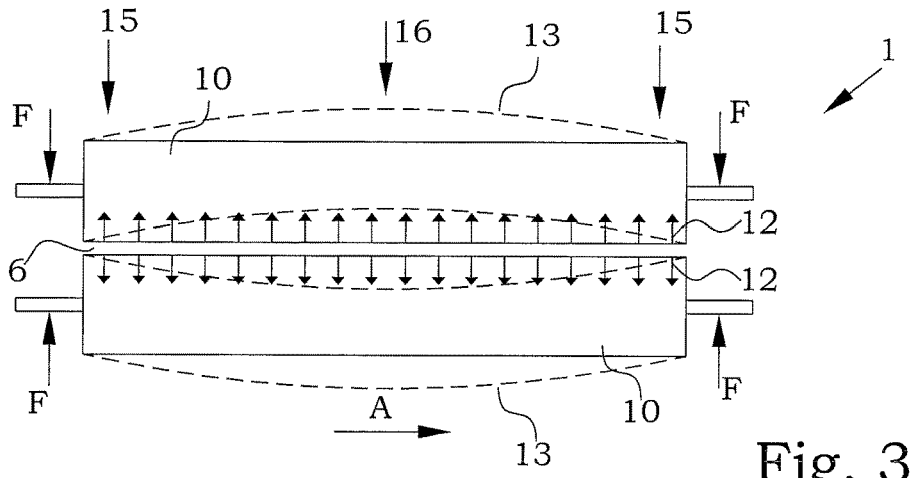
FIG. 3 is a schematic illustration of forces on dewatering rolls.

FIG. 3 illustrates schematically a twin-roll press 1, in which two dewatering rolls 10 are pressed together by forces F. The fibre suspension in the nip section 6 applies a load, illustrates by the arrows 12 onto the dewatering rolls 10 in a direction out from the nip section 6 perpendicular to the direction of the axes of the dewatering rolls 10. The load 12 causes the dewatering rolls 10 to bend, which is illustrated (extremely exaggerated) by the dotted line 13. The bending is largest in the middle part 16 of the dewatering rolls 10, in an axial direction A. Since the forces F are applied to the ends of the dewatering rolls 10, the deviation from the perfectly straight shape is smallest closest to an end part 15 of the dewatering rolls 10, in an axial direction A. This results in, as briefly mentioned in the background, a less efficient dewatering in the central part of the arrangement. If a washing procedure is utilized, the efficiency of the washing also becomes reduced. Thus, the result is a pulp material with a higher liquid content with a higher content of impurities.

Furthermore, the deflection of the dewatering rolls 10 also influences the local load on the dewatering rolls 10. It has been found in experiments that the local load close to the ends 15 of the dewatering rolls 10 increases whereas the local load in the middle 16 of the dewatering rolls 10 decreases. Since the relationship between actual gap size and local load is highly non-linear, the load close to the ends 15 of the dewatering rolls 10 may increase considerably, thereby increasing the risk for overloading the mantle.

Figure 4:
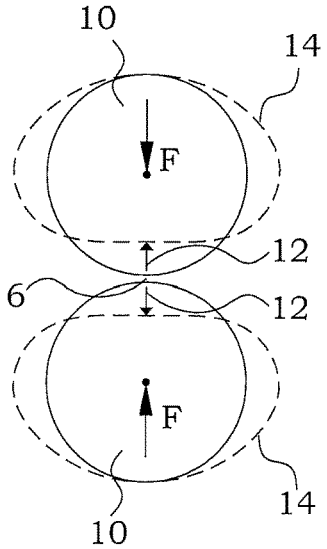
FIG. 4 is a schematic illustration of forces on dewatering rolls in a cross-sectional view.

A deformation of the dewatering rolls is also present in the cross-sectional direction. FIG. 4 schematically illustrates a twin-roll press 1, in which two dewatering rolls 10 are pressed together by forces F. The load 12 in the nip section 6 causes the dewatering rolls 10 to deform their cross-sections, illustrated in an extremely exaggerated way by the dotted line 14.

A straight-forward approach in e.g. paper machines to solve analogous problems is to machine the outer surface of the rolls to assume a slightly differing radius along the axis of the roll. However, in dewatering applications, such approach is not easily achieved. The reason is the dewatering process itself. In a dewatering arrangement, the mantle is perforated to provide mantle flow paths. In order to facilitate the dewatering, the aspect ratio of the hole length to hole diameter has to be kept as low as possible. It is therefore advantageous to have a thin mantle plate. A typical thickness is around 3 mm. For long and slender dewatering rolls deflections caused by the load can be in the order of several millimeters. A machining of the mantle plate thereby becomes impossible. Also, using a thick mantle plate that would allow machining depths of a couple of millimeters will instead give rise to mantle flow paths with too high flow resistance.

Within the paper production industry, there are also arrangements providing paper rolls with adjustable mantle shapes. Heat, as in e.g. the published European patent application EP 0 471 655, or hydraulic pressure, as in the published international patent application WO 96/36817, are used for changing the shape of the paper roll. However, such solutions are not possible to transfer to pulp dewatering applications since heat or hydraulic arrangements within the interior of the rolls severely would interfere with the dewatering function and dewatering flow channels.

The basic solution according to the present invention is based on the idea of leaving the mantle thickness essentially unmodified, but instead provide a static mantle support structure that has the required deflection measures.

Figure 5:
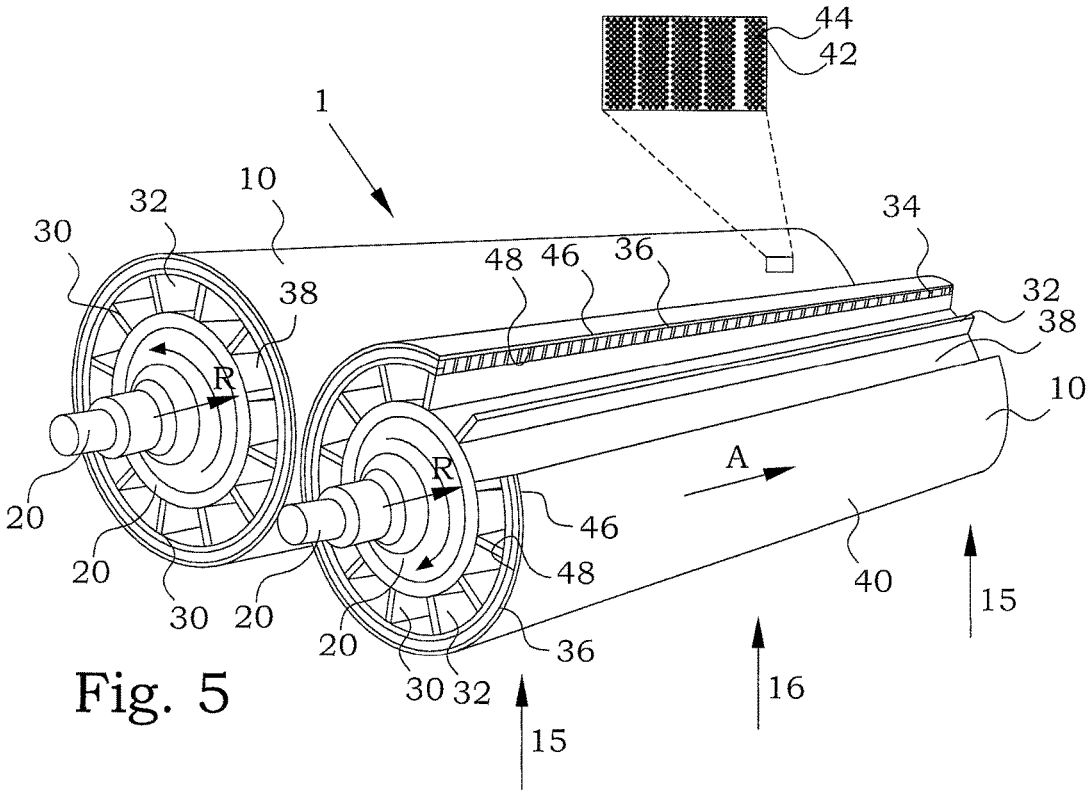
FIG. 5 is an illustration of dewatering rolls of an embodiment of a dewatering press.

FIG. 5 illustrates one embodiment of a dewatering press, in this embodiment a twin roll press 1 with two dewatering rolls 10. Each of the dewatering rolls comprises a roll body 20, a mantle support structure 30 and a mantle 40. The mantle support structure 30 is attached, in a radial direction R, around the roll body 20. The mantle 40 is attached, in the radial direction R, against an outer surface 36 of the mantle support structure 30. The mantle 40 has a plurality of through holes 42 constituting mantle flow paths 44 from an, in the radial direction R, outer surface 46 of the mantle 40 to an, in the radial direction R, inner surface 48 of the mantle 40. The mantle support structure 30 presents support flow paths 38 from the outer surface 36 of the mantle support structure 30. The support flow paths 38 are in fluid contact with the mantle flow paths 44.

In order to supply a high throughput, the structure of the mantle support structure 30 should be as open as possible without any unnecessary disturbing parts. The open structure preferably provides flow paths of low flow resistance. As the person skilled in the art understands, the exact geometrical composition of the mantle support structure 30 can, however, be varied in very different manners. The contact area between the mantle support structure 30 and the mantle 40 has to be kept relatively small, in order to allow the connection of the support flow paths 38 and the mantle flow paths 44. In a typical case, the contact surface is less than ⅓ of the mantle surface. However, the actual contact surface pattern can be designed in different ways. In the embodiment of FIG. 5, the contact is provided in circular paths around the roll body 20. In other embodiments, contacts directed in an axial direction or as helical structures can also be used. Also, contact patterns of mesh types are feasible. The actual pattern of the contact surface is, however, not influencing the basic technical effect of the here presented technology as long as a good connection of the support flow paths 38 and the mantle flow paths 44 is provided.

Similarly, the mantle flow paths 44 can in different embodiments also be designed in different ways. Non-exclusive example can e.g. be different types of slits or holes with circular or non-circular cross-sections.

Again with reference to the embodiment of FIG. 5, the outer surface 36 of the mantle support structure 30 has a static geometric shape defining an envelope having a smaller radius in vicinity of each axial end 15 of the mantle support structure 30 than in vicinity of a centre 16 of the mantle support structure 30. Thereby, the inner surface 48 of the mantle assumes the shape of that envelope. In a preferred embodiment, the mantle has an essentially uniform thickness in the radial direction.

Figure 6:
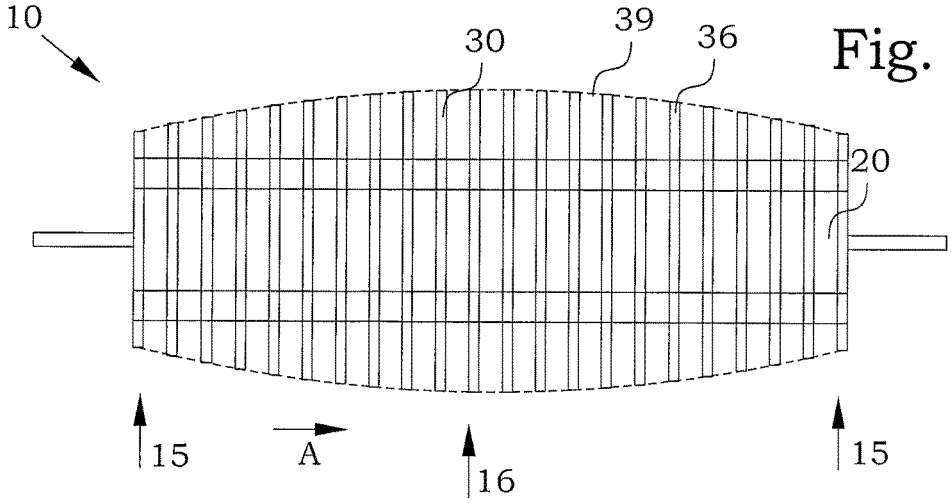
FIG. 6 is a schematic illustration of an embodiment of an envelope of an outer surface of a mantel support structure.

FIG. 6 illustrates schematically an embodiment of a dewatering roll 10 with the mantle removed. The mantle support structure 30 has an outer surface 36 with a geometric shape. This geometric shape defines an envelope 39 connecting the outer surface 36 parts. This envelope 39 thus corresponds to the shape the mantle assumes when being fitted onto the mantle support structure 30. The envelope 39 has a smaller radius in vicinity of each axial end 15 of the mantle support structure 30 than in vicinity of a centre 16 of the mantle support structure 30. Note, that this changing radius is extremely exaggerated in FIG. 6, in order to be visualized. In an actual device, the difference is typically in the order of a fraction of a millimeter up to a couple of millimeters, whereas the dewatering roll 10 length typically is from 0.5 m up to more than 10 m. In the embodiment of FIG. 6, a radius of the envelope 39 is changing monotonously from the centre 16 of the mantle support structure 30 towards each of the axial ends 15 of the mantle support structure 30. The envelope 39 is thus preferably given a shape that compensates for deflection and deformation of the dewatering roll 10 at a pre-defined operation load. When being in operation, the changing radius and the deflection and deformation will ideally cancel each other and a more or less constant gap is provided in the nip section.

Depending on e.g. the distribution of forces, there might be situations where the radius of the envelope 39 is not changing monotonously all the way from the centre 16. However, in most embodiments, the radius of the envelope 39 is changing monotonously over a major part of the distance from the centre 16 of the mantle support structure 30 towards each of the axial ends 15 of the mantle support structure 30.

In the embodiment of FIG. 5, the dewatering press is a twin roll press 1, where both the dewatering rolls 10 are provided with the changing radius according to FIG. 6. However, in an alternative embodiment, one of the dewatering rolls could be manufactured according to prior-art as a straight roll, whereas the other dewatering roll could be given a changing radius compensating for the deflection and deformation of both dewatering rolls. This will give rise to a nip section that is slightly bent between the dewatering rolls, but any disadvantages of having such a bent nip section are expected to be very small. In such a way, the deflection compensation only has to be performed on one of the dewatering rolls, thereby saving production time and complexity.

A dewatering press may also be designed only having one dewatering roll. In such a dewatering press, the counteracting surface can be a non-dewatering roll or more or less any relatively flat surface. The same principles about deflection compensation of the dewatering roll can, however, by advantage also be used in such dewatering presses.

In a typical industrial dewatering press, small deviations from a perfect constant gap between the dewatering rolls are acceptable. In typical prior art arrangements, deviations of up to 0.2-1 mm on the gap, i.e. 0.1-0.5 mm in radial difference for each roll in a twin-roll arrangement, are typically considered as neglectable concerning impact on dewatering efficiency and increased end load. The impact of the present ideas on systems having deflection less than 0.5 mm from an ideal straight shape is thus limited. However, envelopes that are given a shape having a radius in the centre, in the axial direction, that is at least 0.5 mm larger than a radius close to an axial end of the mantle support structure, will in many cases have a significant impact on the quality of the dewatering process.

This acceptable deviance from a perfectly compensated deflection also opens up for different shapes of the envelope. The envelope shape can thereby be modified from the ideal deflection compensation shape without causing any significant disadvantages. Typically, in test experiments, if the resulting gap of a twin-roll arrangement varies less than 0.2 mm, almost no reduction in dewatering efficiency can be detected. If the resulting gap varies less than 1 mm, the effect on the dewatering efficiency is still small, however, noticeable. Also resulting gap varying less than 2 mm could be used, at least if the absolute measure of the gap is relatively wide.

Figure 7:
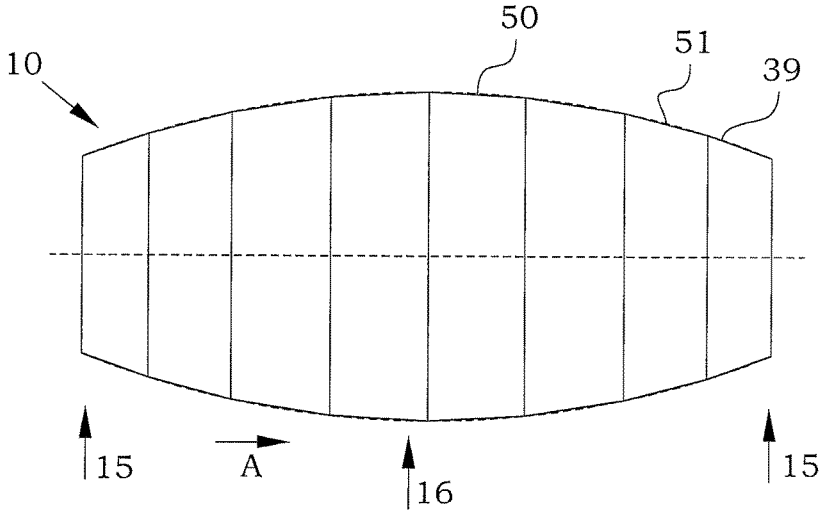
FIG. 7 is a schematic illustration of an embodiment of a mantel support structure having linearly varying radiuses.

These allowed deviances from a perfect compensated shape open up for using simpler shapes for the envelope, which simpler shapes are easier to manufacture and/or control. In particular embodiments, the radius of the envelope is manufactured to vary piecewise linearly in the axial direction. In FIG. 7, an envelope 39 of a mantle support structure is schematically depicted. In this embodiment, the radius of the envelope 39 decreases piecewise linearly in the axial direction A from the centre 16 of the mantle support structure towards each of the axial ends 15 of the mantle support structure. In other words, the envelope consists of linearly varying sections 51, connected to each other at the ends thereof. By selecting the widths and slopes of these linearly varying sections 51 in a suitable manner, the difference in radius compared to an ideal deflection compensating curve 50 can be kept very small. Note that the illustrated changes in radius are extremely exaggerated.

Figure 8:
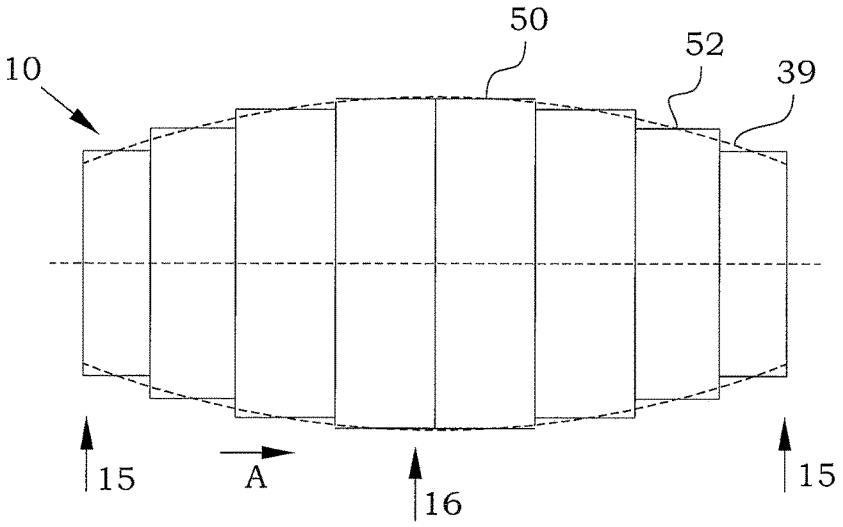
FIG. 8 is a schematic illustration of another embodiment of a mantel support structure having linearly varying radiuses.

In FIG. 8, an envelope 39 of a mantle support structure of another embodiment is schematically depicted. Also in this embodiment, the radius of the envelope is manufactured to be piecewise linearly in the axial direction. In this embodiment, the radius of the envelope 39 is piecewise constant in the axial direction A. In other words, the envelope consists of sections 52 having a constant radius. The sections 52 are connected to each other at the ends thereof, thereby creating a step in the radius. By selecting the widths and step sizes of these sections 52 in a suitable manner, the difference in radius compared to an ideal deflection compensating curve 50 can anyway be kept very small. Note that the illustrated changes in radius are extremely exaggerated.

Figure 9:
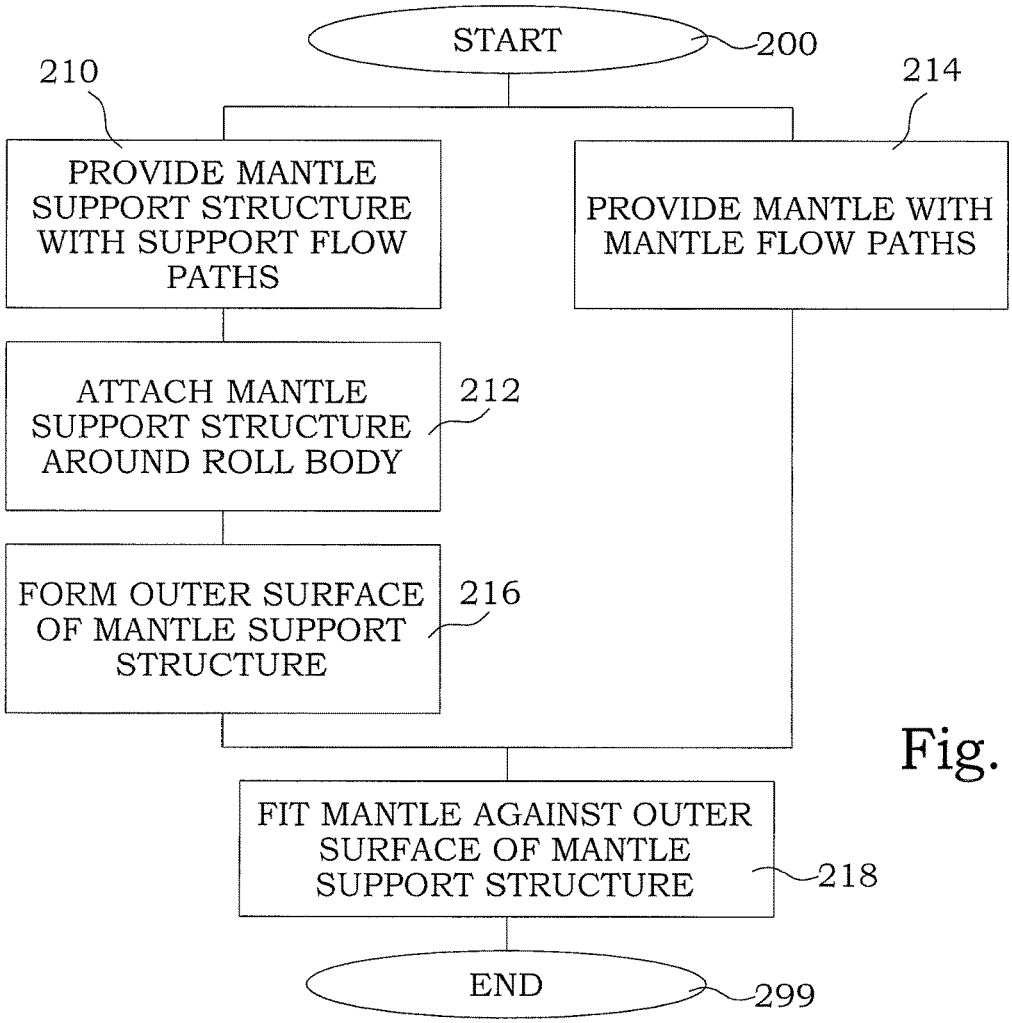
FIG. 9 is a flow diagram of steps of an embodiment of a method for manufacturing a dewatering roll.

FIG. 9 illustrated a flow diagram of steps of an embodiment of a method for producing a dewatering roll. The procedure starts in step 200. In step 210 a mantle support structure is provided with support flow paths from an, in a radial direction, outer surface of the mantle support structure. In step 212, the mantle support structure is attached around a roll body. In step 214, a mantle is provided with a plurality of through holes. The through holes constitute mantle flow paths from an, in the radial direction, outer surface of the mantle to an, in the radial direction, inner surface of the mantle. In step 216, the outer surface of the mantle support structure is formed to obtain a static geometric shape defining an envelope having a smaller radius in vicinity of each axial end of the mantle support structure than in vicinity of a centre of the mantle support structure. In step 218, occurring after step 216, the mantle is fitted against the outer surface of the mantle support structure. The support flow paths are thus brought in fluid contact with the mantle flow paths. The procedure ends in step 299.

In this particular embodiment, the step of fitting 218 the mantle against the outer surface of the mantle support structure is performed by shrink-fitting. The mantle is typically provided with an inner radius that is somewhat smaller than the smallest radius of the portion of the mantle support structure it is intended to cover. The mantle is heated, whereby it expands. During this elevated temperature, the mantle is fitted around the mantle support structure and is then allowed to cool down. By means of the accompanied shrinking of the mantle, the mantle will be shrink-fitted onto the mantle support structure. This means that the inner surface of the mantle assumes the shape of the envelope as a result of the shrink-fitting.

In a particular embodiment, the mantle is fitted onto the mantle support structure in sections, whereby the original radius of the mantle is adapted to the respective mantle support structure section. If the changes in radius within such a mantle support structure section is moderate, the mantle can be originally provided before the shrink-fitting with a constant radius, whereby the shrink-fitting will cause the mantle to assume a shape similar to the envelope.

It is in alternative embodiment possible to provide the mantle already from the beginning with the required variation in radius. In other words, the step of providing a mantle then comprises shaping the mantle to by its inner surface assume the shape of the envelope. The mantle can then be stuck onto the mantle support structure and attached by any appropriate means. In such an embodiment, it is preferred to have the mantle divided in at least two part section, which can be slipped onto the mantle support structure from opposite directions, since the mantle support structure is widest in the middle.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A dewatering roll, comprising a roll body;

a mantle support structure having an outer surface, a pair of axial ends, a central portion, a plurality of support ribs, and ring elements attached to said plurality of support ribs attached, in a radial direction, around said roll body; and a mantle having an outer surface and an inner surface, attached, in said radial direction, against said outer surface of said mantle support structure;

said mantle having a plurality of through holes constituting mantle flow paths from, in said radial direction, said outer surface of said mantle to, in said radial direction, said inner surface of said mantle;

said mantle support structure presenting support flow paths from said outer surface of said mantle support structure, said support flow paths being in fluid contact with said mantle flow paths;

said outer surface of said mantle support structure having a static geometric shape defining an envelope having a smaller radius in vicinity of each one of said axial ends of said mantle support structure than in vicinity of said central portion of said mantle support structure, whereby said inner surface of said mantle assumes the shape of said envelope.

2. The dewatering roll according to claim 1, wherein said envelope is given a shape compensating for deflection and deformation of said dewatering roll at a pre-defined operation load.

3. The dewatering roll according to claim 2, wherein said envelope is given a shape having a radius in said central portion, in an axial direction, that is at least 0.5 mm larger than a radius close to at least one of said axial ends of said mantle support structure.

4. The dewatering roll according to claim 1, wherein a radius of said envelope changes continuously over a major part of the distance from said central portion of said mantle support structure towards each of said axial ends of said mantle support structure.

5. The dewatering roll according to claim 4, wherein a radius of said envelope changes continuously from said central portion of said mantle support structure towards each of said axial ends of said mantle support structure.

6. The dewatering roll according to claim 1, wherein said radius of said envelope varies stepwise linearly in said axial direction.

7. The dewatering roll according to claim 6, wherein said radius of said envelope decreases stepwise linearly in said axial direction from said central portion of said mantle support structure towards each of said axial ends of said mantle support structure.

8. The dewatering roll according to claim 1, wherein said radius of said envelope is stepwise constant in said axial direction.

9. The dewatering roll according to claim 1, wherein said mantle has an essentially uniform thickness in said radial direction.

10. A dewatering press comprising at least one dewatering roll according to claim 1.

11. The dewatering press according to claim 10, wherein the dewatering press comprises two dewatering rolls according to claim 1, arranged side by side parallel to each other.

12. A method for producing a dewatering roll, comprising the steps of:

providing a mantle support structure with support flow paths from, in a radial direction, an outer surface of said mantle support structure;

wherein the mantle support structure includes a pair of axial ends, a central portion, a plurality of support ribs, and ring elements attached to said plurality of support ribs;

attaching said mantle support structure around a roll body;

providing a mantle with a plurality of through holes constituting mantle flow paths from, in said radial direction, an outer surface of said mantle to, in said radial direction, an inner surface of said mantle;

forming said outer surface of said mantle support structure to obtain a static geometric shape defining an envelope having a smaller radius in the vicinity of each axial end of said mantle support structure than in the vicinity of the center of said mantle support structure; and fitting, after said step of forming, said mantle against said outer surface of said mantle support structure;

whereby said support flow paths is brought in fluid contact with said mantle flow paths.

13. The method according to claim 12, wherein said step of fitting said mantle against said outer surface of said mantle support structure is performed by shrink-fitting whereby said inner surface of said mantle assumes the shape of said envelope by said shrink-fitting.

14. The method according to claim 12, wherein said step of providing a mantle comprises shaping said mantle so that its inner surface assumes the shape of said envelope.

* * * * *